US005908440A

United States Patent [19]

McCloskey et al.

[11] Patent Number: 5,908,440

[45] Date of Patent: Jun. 1, 1999

[54] INFANT TEETHER

[76] Inventors: Gregory McCloskey; Deborah Vaughn McCloskey, both of P.O. Box 78, 7 Seventh St., Flagtown, N.J. 08821

[21] Appl. No.: 09/102,228

[22] Filed: Jun. 22, 1998

[51] Int. Cl.[6] ..... A61J 17/00

[52] U.S. Cl. ..... 606/234; 606/235; 606/236

[58] Field of Search ..... 606/234, 235, 606/236

[56] References Cited

U.S. PATENT DOCUMENTS

| | | | |
|---|---|---|---|
| 2,824,561 | 2/1958 | Mueller | 606/234 |
| 4,192,307 | 3/1980 | Baer | 606/236 |

*Primary Examiner*—Michael Buiz
*Assistant Examiner*—Tan-Uyen T. Ho
*Attorney, Agent, or Firm*—Goldstein & Canino

[57] ABSTRACT

An infant teether comprising a hollow teething unit defined in part by thin, flexible walls for holding hard teething foods such as cookies, pretzels, fruits, and the like. The walls of the teething unit are provided with a plurality of holes for allowing the food therein to be released into the infant's mouth in small, soft pieces, upon a repetitive biting action on the teething unit. The infant teether further comprises a cap for closing an opening in the teething unit to prevent food spillage during use. A ring-shaped handle is integrally attached to the cap for easy grip by the child or parent. The food placed inside the teething unit encourages the infant to repetitively bite on the unit in an effort to consume the food therein. This repetitive biting action upon the elastomeric teething unit can bring soothing relief to the infant during teething.

1 Claim, 2 Drawing Sheets

INFANT TEETHER

BACKGROUND OF THE INVENTION

This invention relates to an infant teether. More particularly, the invention relates to an infant teether which serves to contain teething foods and is adapted to release small pieces of the food into the infant's mouth as the food inside the teether is chewed and sucked on.

Teething rings and teething foods have long been considered valuable items among the parents of infants who are undergoing painful teething. A repetitive biting action upon semi-hard items, such as teething rings and teething foods can often be soothing and relaxing to a baby during teething. Although the teething rings may be convenient to use, the traditional plastic and rubber teethers lack taste and are not appealing to babies. Consequently, the traditional teether are often tossed to the side and forgotten after only a few moments. Teething cookies and pretzels are much more compelling to children, in that they are deliciously flavored. However, teething cookies represent a potential choking hazard, and parents or caregivers must remain alert and periodically check for large, hard pieces of food inside the child's mouth. Therefore, there is still a further need to provide an improved infant teether. Such an infant teether should be appealing to a teething child and encourages a repetitive biting action upon the semi-hard teether to help soothe the pain of teething. Moreover, such an infant teether should enable an infant to enjoy consumption of delicious teething food without the risk of choking.

While these units mentioned above may be suitable for the particular purpose employed, or for general use, they would not be as suitable for the purposes of the present invention as disclosed hereafter.

SUMMARY OF THE INVENTION

It is an object of the invention to provide an infant teether which is simple in construction so as to minimize manufacturing cost, and yet is capable of relieving pain associated with teething.

It is another object of the invention to provide an infant teether which enable an infant to enjoy consumption of teething food such as cookies, pretzels, fruits, and the like, without the risk of choking hazard.

It is yet another object of the invention to provide an infant teether utilizing a hollow teething unit for containing teething food, wherein hollow teething unit has a plurality of holes adapted to release small pieces of the food upon a repetitive biting action on the teething unit and the food retained therein.

The invention is an infant teether comprising a hollow teething unit defined in part by thin flexible walls for holding hard teething foods such as cookies, pretzels, fruits, and the like. The walls of the teething unit are provided with a plurality of holes for allowing the food therein to be released into the infants mouth in small, soft pieces, upon a repetitive biting action on the teething unit. The infant teether further comprises a cap for closing an opening in the teething unit to prevent food spillage during use. A ring-shaped handle is integrally attached to the cap for easy grip by the child or parent. The food placed inside the teething unit encourages the infant to repetitively bite on the unit, in an effort to consume the food therein. This repetitive biting action upon the elastomeric teething unit can bring soothing relief to the infant during teething.

To the accomplishment of the above and related objects, the invention may be embodied in the form illustrated in the accompanying drawings. Attention is called to the fact, however, that the drawing are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
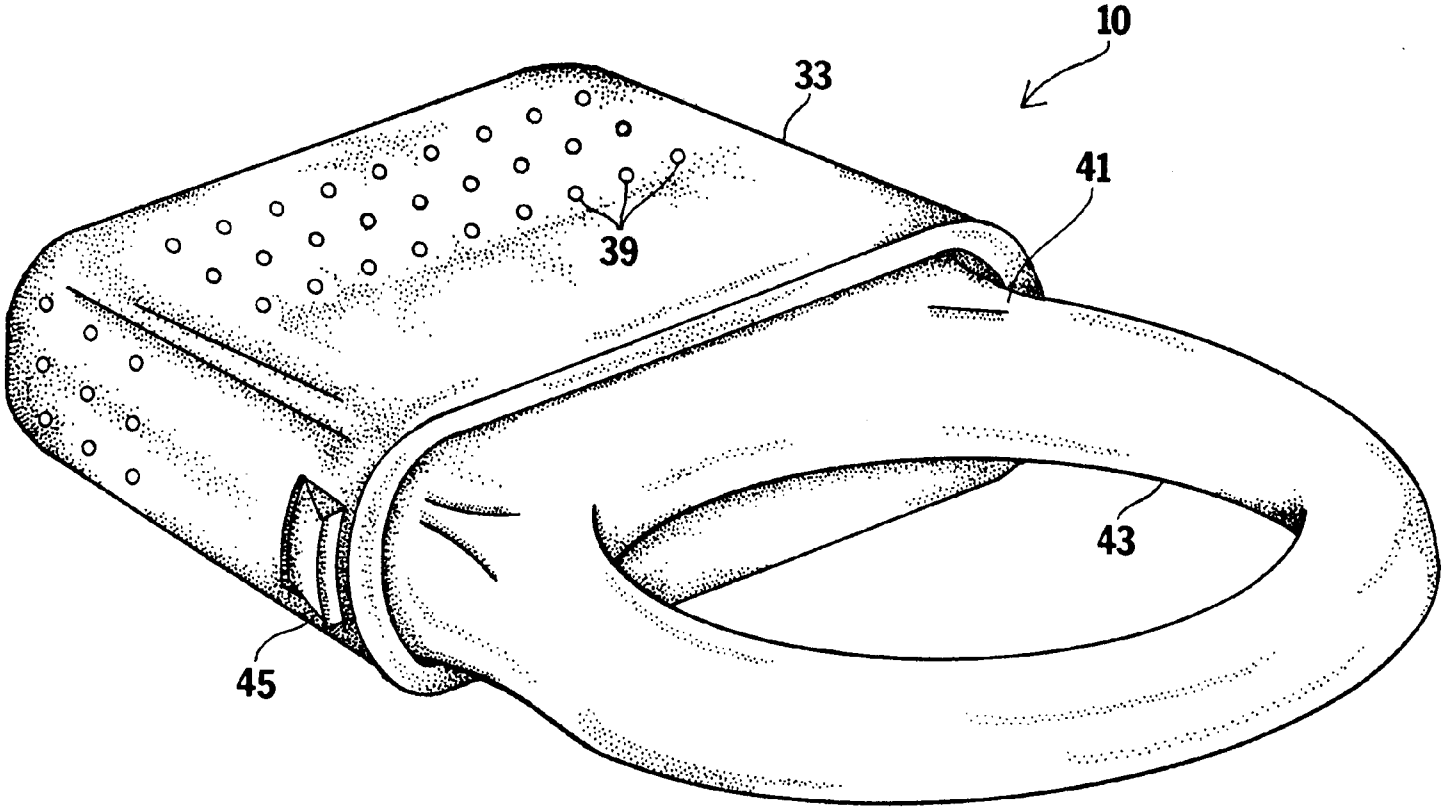
FIG. 1 is a diagrammatic perspective view of an infant teether in accordance with the principles of the present invention.

FIG. 1 illustrates a preferred embodiment of an infant teether 10 in accordance with the principles of the present invention. As will be seen in following paragraphs, the infant teether 10 of the present invention is designed to contain tasty teething foods to encourage a repetitive biting action thereupon in order to relieve the pain associated with teething and to help new teeth to break through the gum line.

Figure 2:
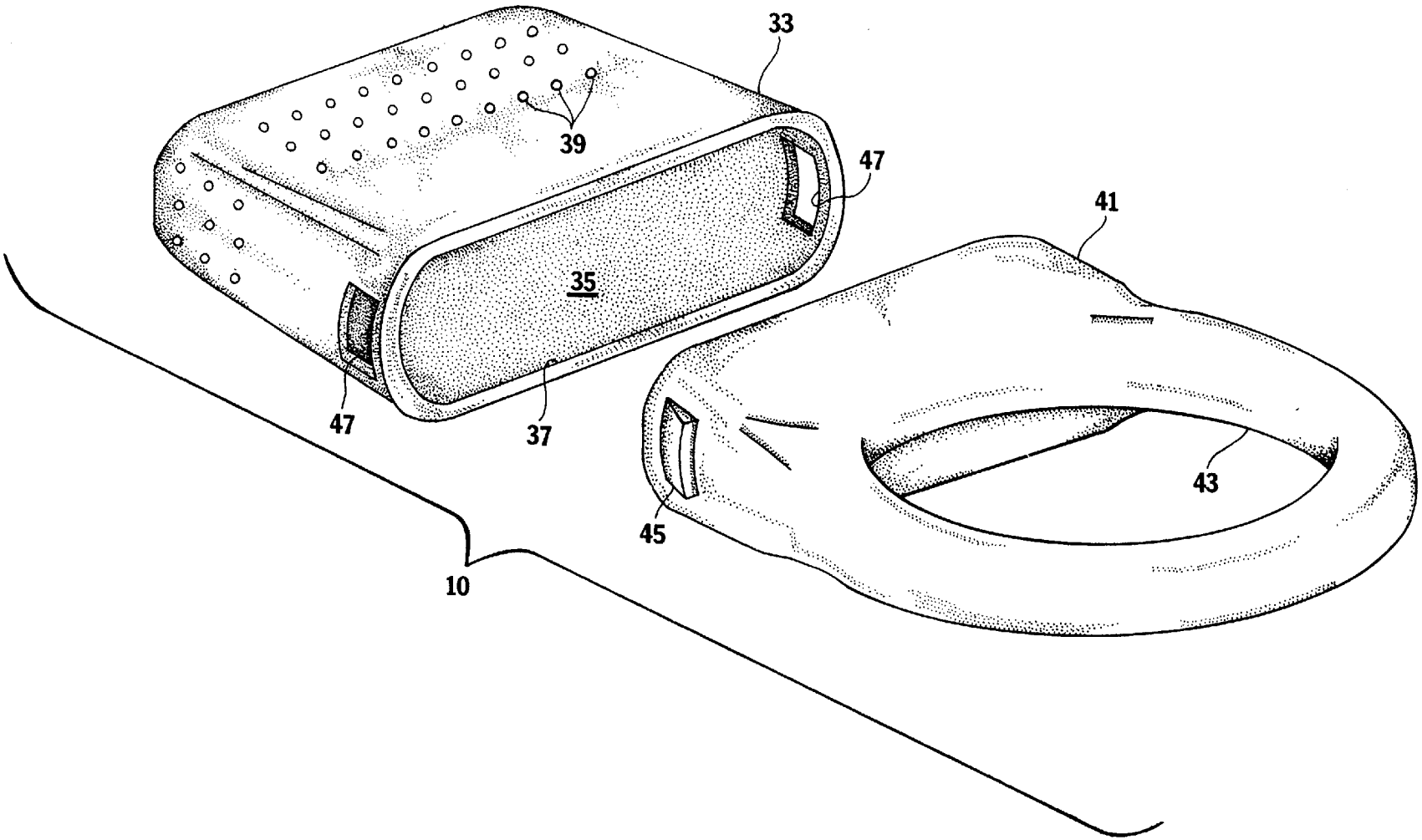
FIG. 2 is a diagrammatic perspective view of the infant teether with the cap removed from the teething unit.

As seen by referring to FIG. 2, the infant teether 10 comprises a hollow teething unit 33 defined in part by thin, flexible walls constructed of soft rubber material or any other suitable elastomeric material as would be appreciated by those skilled in the art. The teething unit 33 has an internal hollow space 35 for holding hard teething foods such as cookies, pretzels, fruits, and the like, and an opening 37 for permitting insertion and filling of the internal hollow space 35 with food. The walls of the teething unit 33 are provided with a plurality of food dispensing holes 39 for allowing the food therein to be released into the infant's mouth in small, soft pieces, upon a repetitive biting action on the teething unit 33 and the food contained therein. In this manner, the infant teether 10 helps the baby relieve the pain of teething while enabling the infant to enjoy consumption of tasty teething foods. The size of the food dispensing riles 39 is selected to allow small, soft pieces of food to seep out of the teething unit 33, while prohibiting large pieces of the food within the unit from breaking off and entering the baby's mouth to eliminate the risk of choking.

The infant teether 10 of the present invention also includes a cap 41 for closing the opening 37 of the teething unit 33 to prevent food spillage during use. A ring-shaped handle 43 is integrally molded to the cap 41 for easy grip by the child or parent. The cap 41 and the teething unit 33 can be locked together when the infant teether 10 is being used, and can be taken apart where food is being inserted, or when cleaning thereof is desired. The connecting means for detachably connecting the cap 41 to the teething unit 33 may be carried out in a number of ways. In the preferred embodiment, the cap 41 is provided with snap lock parts 45 extending outwardly from the external sides thereof and apertures 47 are formed on the teething unit 33 adapted for receiving the snap lock parts 45 on the cap 41. Although the preferred embodiment of the present invention utilizes the snap locking means to hold the two pieces together, it should be noted that the connecting means of the present invention can take any other suitable form capable of releasably securing the cap to the teething unit to prevent food spillage during use.

The operation of the infant teether 10 will now be described. To help relieve the pain associated with teething, a suitable teething food is placed inside the teething unit 33, preferably of kind that is appealing to the infant. Because the teething food is deliciously flavored, the infant is likely to repeatably bite on the teething unit 33 in an effort to consume the food therein. This repetitious biting action can be soothing and relaxing to the infant during teething and can help the new teeth to break through the gum line. In addition, a small amount of food is released through the holes 39 in the teething unit 33, as the infant bites on it, enabling the infant to enjoy consumption of tasty teething food. Because large pieces of food cannot escape from the infant teether 10 into the infant's mouth, the parent or the caregiver of the infant does not have to be concerned about the choking hazard, as would be required with manually feeding teething foods, such as teething cookies, fruits, and the like.

Many specific details contained in the above description merely illustrate some preferred embodiments and should not be construed as a limitation on the scope of the invention. Many other variations are possible.

What is claimed is:

1. An infant teether comprising:

a) a hollow teething unit having an internal hollow space defined by flexible walls constructed of an elastomeric material for holding food and an opening for permitting insertion and filling of said internal hollow space with food;

b) dispensing means for allowing said food contained within said teething unit to be released into an infant's mouth in small pieces upon a repetitive biting action on said teething unit, the dispensing means comprises a plurality of food dispensing holes provided in the walls of the teething unit, said dispensing holes sized to allow small, soft pieces of food to seep out of the teething unit, while prohibiting large pieces of the food within the unit from breaking off and entering the infant's mouth to eliminate the risk of choking;

c) a cap for closing said opening in said teething unit for preventing food spillage during use, the cap further having a ring-shaped handle integrally molded therewith for easy grip by an infant or a caregiver; and d) connecting means for detachably connecting said cap to said teething unit at said opening, the connecting means comprises a pair of snap lock parts, each extending outwardly from opposite sides of the cap, and apertures formed on the teething unit adapted to receive said snap lock parts for releasably locking the cap and the teething unit together.

* * * * *